US011041508B2

(12) United States Patent
Chen et al.

(10) Patent No.: US 11,041,508 B2
(45) Date of Patent: Jun. 22, 2021

(54) AIR MOVER

(71) Applicant: Delta Electronics, Inc., Taoyuan (TW)

(72) Inventors: En-Feng Chen, Taoyuan (TW); Hsu-Fan Al, Taoyuan (TW); Wen-Hsiang Lin, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 120 days.

(21) Appl. No.: 16/201,118

(22) Filed: Nov. 27, 2018

(65) Prior Publication Data

US 2019/0277305 A1 Sep. 12, 2019

(30) Foreign Application Priority Data

Mar. 8, 2018 (CN) ..... 201810190509.5

(51) Int. Cl.

| | |
|---|---|
| ***F04D 29/42*** | (2006.01) |
| ***F04D 29/62*** | (2006.01) |
| ***F04D 25/06*** | (2006.01) |
| ***F04D 17/16*** | (2006.01) |
| ***F04D 25/16*** | (2006.01) |

(52) U.S. Cl.

CPC ..... *F04D 29/424* (2013.01); *F04D 17/16* (2013.01); *F04D 17/162* (2013.01); *F04D 25/0606* (2013.01); *F04D 25/0693* (2013.01); *F04D 25/166* (2013.01); *F04D 29/4226* (2013.01); *F04D 29/626* (2013.01)

(58) Field of Classification Search

CPC .... F04D 17/16; F04D 17/162; F04D 25/0606; F04D 25/0693; F04D 25/163; F04D 25/166; F04D 29/4226; F04D 29/424; F04D 29/626; F04D 29/661

See application file for complete search history.

(56) References Cited

U.S. PATENT DOCUMENTS

| | | | | |
|---|---|---|---|---|
| 2,814,432 | A * | 11/1957 | Eiserman | F04D 17/162 417/350 |
| 2,823,852 | A * | 2/1958 | Busch | F04D 17/162 417/350 |
| 9,109,610 | B2 * | 8/2015 | Streng | F04D 25/06 |
| 9,157,441 | B2 * | 10/2015 | Dickinson | F04D 25/0606 |
| 9,574,568 | B2 * | 2/2017 | Dickinson | F04D 25/0613 |
| 9,863,698 | B1 * | 1/2018 | Turner | F26B 3/04 |
| 2013/0216410 | A1 * | 8/2013 | Patterson | F04D 17/162 417/420 |

* cited by examiner

*Primary Examiner* — Patrick Hamo
*Assistant Examiner* — Joseph S. Herrmann
(74) *Attorney, Agent, or Firm* — Muncy, Geissler, Olds & Lowe, P.C.

(57) ABSTRACT

An air mover is provided. The air mover includes a housing, a spacer, a co-axial motor, a first fan and a second fan. The housing includes a first housing member and a second housing member. A first inlet, a second inlet and an outlet are formed on the housing. The first inlet is formed on the first housing member and the second inlet is formed on the second housing member. The spacer is disposed between the first housing member and the second housing member. The co-axial motor includes a shaft, wherein the co-axial motor is disposed on the spacer. The shaft includes a first free end and a second free end. The first free end extends in a first direction, and the second free end extends in a second direction.

9 Claims, 10 Drawing Sheets

D

D

D

D

AIR MOVER

CROSS REFERENCE TO RELATED APPLICATIONS

This application claims priority of China Patent Application No. 201810190509.5, filed on Mar. 8, 2018, the entirety of which is incorporated by reference herein.

BACKGROUND OF THE INVENTION

Field of the Invention

The present invention relates to an air mover, and in particular to an air mover with two inlets.

Description of the Related Art

A conventional air mover (for example, a carpet drier) has a motor, a fan, two inlets, and an outlet. Conventionally, the motor is disposed on one side of the air mover. This can cause the weight distribution of the conventional air mover to be uneven, and the air mover can be difficult to carry. Additionally, the motor and the fan are adjacent to one side of the air mover, and the intake flow rates at the two inlets are different. The great difference between the intake flow rates at the two inlets causes noise, and decreases the output flow rate of the air mover.

BRIEF SUMMARY OF THE INVENTION

In one embodiment, an air mover is provided. The air mover includes a housing, a spacer, a co-axial motor, a first fan, and a second fan. The housing includes a first housing member and a second housing member, wherein a first inlet, a second inlet and an outlet are formed on the housing, the first inlet is formed on the first housing member and the second inlet is formed on the second housing member. The spacer is disposed between the first housing member and the second housing member. The co-axial motor includes a shaft, wherein the co-axial motor is disposed on the spacer, the shaft comprises a first free end and a second free end, the first free end extends in a first direction, and the second free end extends in a second direction. The first fan is connected to the first free end, wherein the first fan is located in a first chamber formed by the first housing member and the spacer, and the first fan corresponds to the first inlet. The second fan is connected to the second free end, wherein the second fan is located in a second chamber formed by the second housing member and the spacer, and the second fan corresponds to the second inlet.

In one embodiment, a first distance between the first free end and the spacer is equal to a second distance between the second free end and the spacer.

In one embodiment, the air mover further comprises a mounting base, wherein the spacer comprises a first surface and a second surface, the co-axial motor comprises a motor body, the mounting base is disposed on the second surface, the motor body passes through the spacer, and the mounting base affixes the motor body to the spacer.

In one embodiment, the co-axial motor comprises a cable, the cable is connected to the motor body, and the cable travels from the motor body, extends over the first surface, passes through a cable notch of the first housing member, and leaves the first chamber.

In one embodiment, the air mover further comprises at least one positioner, wherein the positioner is disposed on the first surface and restricts the cable.

In one embodiment, the air mover further comprises a controller, wherein the housing comprises a recess, the recess is formed above a seam line between the first housing member and the second housing member, the controller is embedded in the recess, the cable notch is located on the bottom of the recess, and the cable is coupled to the controller.

In one embodiment, the air mover further comprises a plurality of first bolts, the first housing member comprises a plurality of fastening bases, the second housing member and the spacer have a plurality of through holes, each first bolt passes through the corresponding through hole and is affixed to the corresponding fastening base, and the first bolts connect the second housing member, the spacer and the first housing member.

In one embodiment, the housing comprises a first rib, the first rib is formed on a seam line between the first housing member and the second housing member, and the first rib corresponds to the recess.

In one embodiment, the housing comprises a bottom surface, a plurality of supporting portions and a second rib, the supporting portions and the second rib are formed on the bottom surface, and the second rib is formed on a seam line between the first housing member and the second housing member.

In one embodiment, the spacer separates the first chamber and the second chamber, a first flow enters the first chamber through the first inlet and is impelled by the first fan to leave the first chamber via the outlet, and a second flow enters the second chamber through the second inlet and is impelled by the second fan to leave the second chamber via the outlet.

In one embodiment, on a projection plane, a reverse point is formed between a chamber profile of the first chamber and an outlet profile of the outlet, a tangent line of the chamber profile on the reverse point overlaps an edge of the spacer.

In one embodiment, the radius of the first fan is equal to the radius of the second fan.

In one embodiment, the size of the first inlet is equal to the size of the second inlet.

Utilizing the air mover of the embodiment of the invention, the co-axial motor is disposed on the spacer located in the center of the air mover, the weight distribution of the air mover is uniform, and the air mover can be easily carried. Additionally, the co-axial motor rotates the first fan and the second fan simultaneously, the flow rate of a first flow through the first inlet approximates to the flow rate of a second flow through the second inlet. The noise of the air mover is decreased, and the output flow rate of the air mover is increased. In one embodiment, the first distance is equal to the second distance, and the uniformity of the weight distribution and the intake flow rates are further improved.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
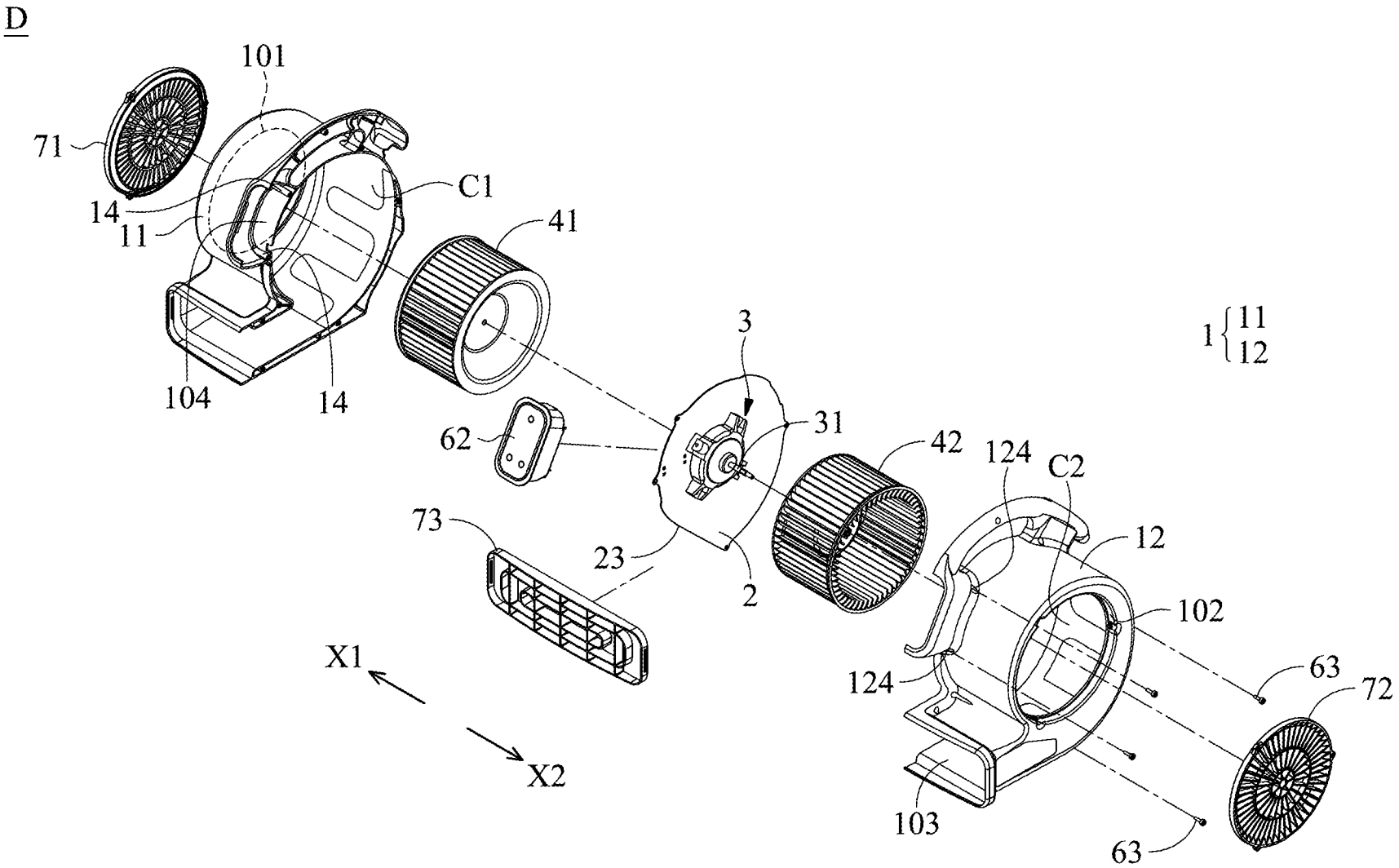
FIG. 1A is an exploded view of an air mover of an embodiment of the invention.
Figure 1B:
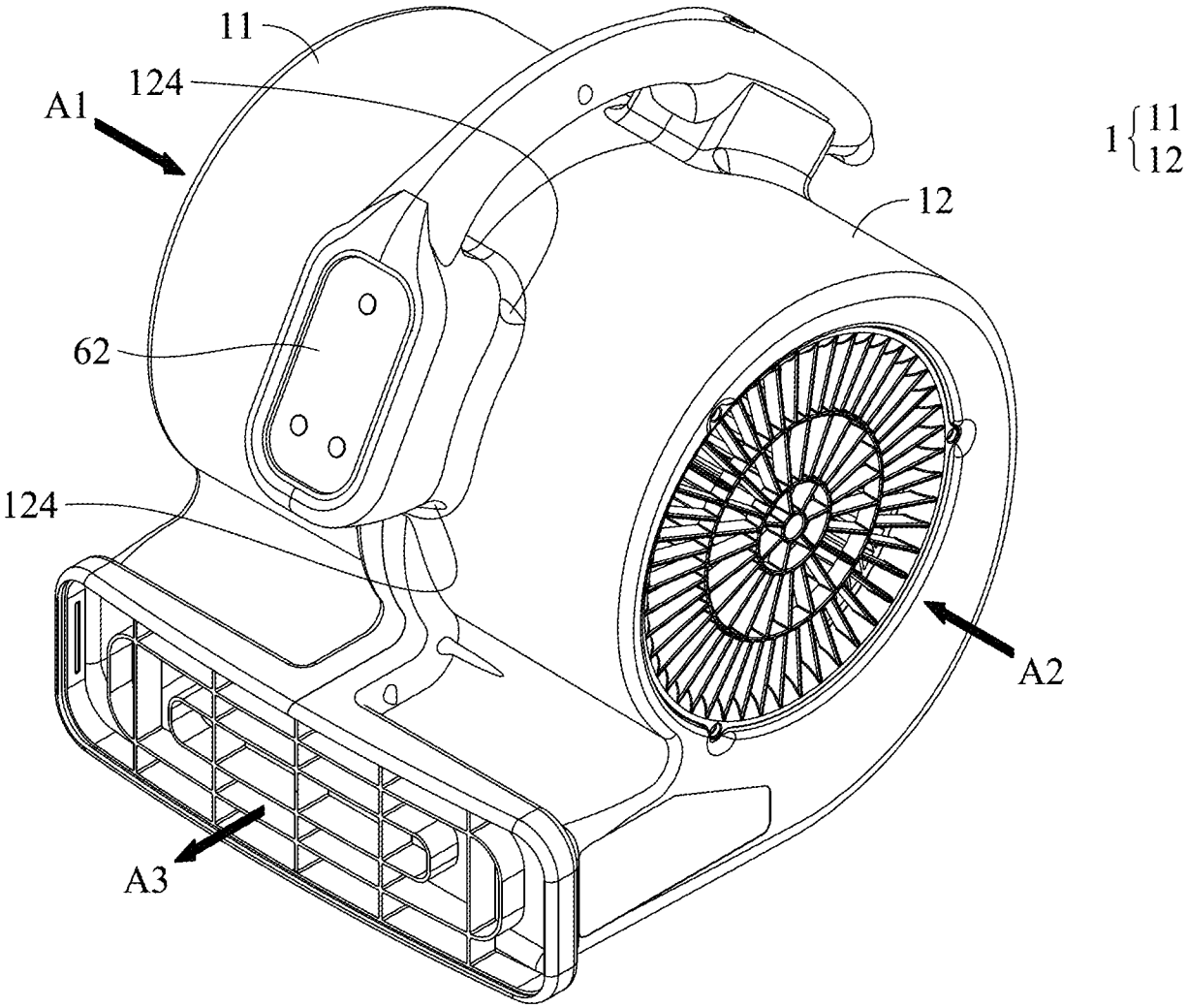
FIG. 1B is an assembled view of the air mover of the embodiment of the invention.

FIG. 1A is an exploded view of an air mover of an embodiment of the invention. FIG. 1B is an assembled view of the air mover of the embodiment of the invention. With reference to FIGS. 1A and 1B, the air mover D of the embodiment of the invention includes a housing 1, a spacer 2, a co-axial motor 3, a first fan 41 and a second fan 42. The housing 1 includes a first housing member 11 and a second housing member 12. A first inlet 101, a second inlet 102 and an outlet 103 are formed on the housing 1. The first inlet 101 is formed on the first housing member 11. The second inlet 102 is formed on the second housing member 12. The spacer 2 is disposed between the first housing member 11 and the second housing member 12. In one embodiment of the invention, the radius of the first fan is equal to the radius of the second fan, or the chord length of the first fan is equal to the chord length of the second fan. In one embodiment, the size of the first inlet is equal to the size of the second inlet.

Figure 2:
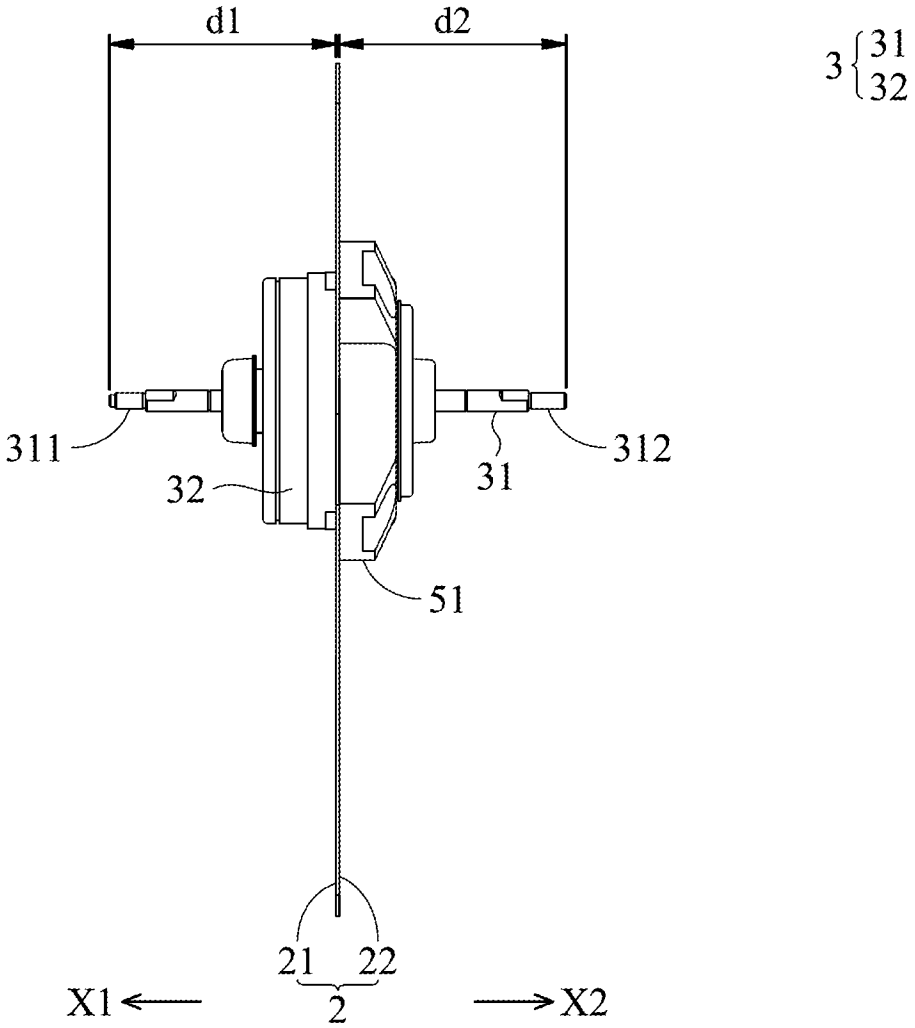
FIG. 2 is a front view of a portion of the spacer and the co-axial motor of the embodiment of the invention.

FIG. 2 is a front view of a portion of the spacer and the co-axial motor of the embodiment of the invention. The co-axial motor 3 includes a shaft 31. The co-axial motor 3 is disposed on the spacer 2. The shaft 31 comprises a first free 311 end and a second free end 312. The first free end 311 extends in a first direction X1. The second free end 312 extends in a second direction X2. With reference to FIGS. 1A, 1B and 2, the first fan 41 is connected to the first free end 311, wherein the first fan 41 is located in a first chamber C1 formed by the first housing member 11 and the spacer 2. The first fan 41 corresponds to the first inlet 101. The second fan 42 is connected to the second free end 312, wherein the second fan 42 is located in a second chamber C2 formed by the second housing member 12 and the spacer 2, and the second fan 42 corresponds to the second inlet 102.

With reference to FIG. 2, in one embodiment, a first distance d1 between the first free end 311 and the spacer 2 is equal to a second distance d2 between the second free end 312 and the spacer 2.

Utilizing the air mover of the embodiment of the invention, the co-axial motor is disposed on the spacer located in the center of the air mover, the weight distribution of the air mover is uniform, and the air mover can be easily carried. Additionally, the co-axial motor rotates the first fan and the second fan simultaneously, the flow rate of a first flow through the first inlet approximates to the flow rate of a second flow through the second inlet. The noise of the air mover is decreased, and the output flow rate of the air mover is increased. In one embodiment, the first distance is equal to the second distance, and the uniformity of the weight distribution and the intake flow rates are further improved.

Figure 3A:
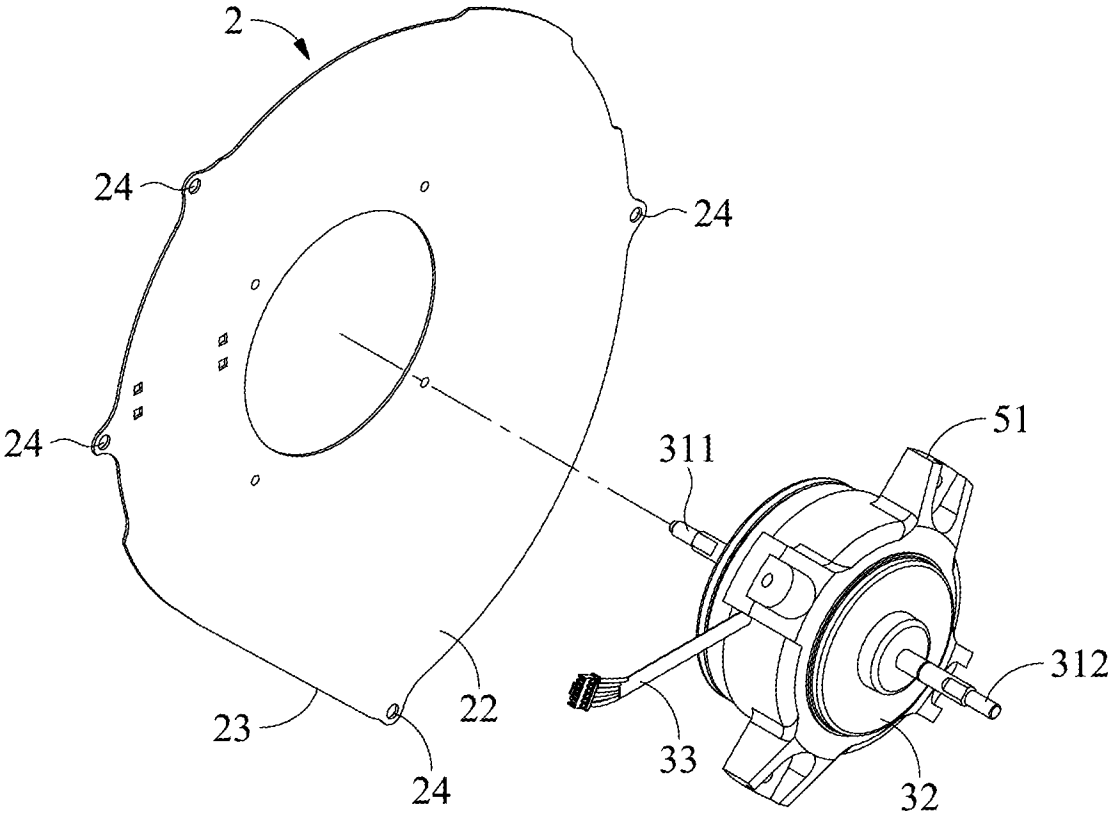
FIG. 3A is an exploded view of the details of the spacer and the co-axial motor of the embodiment of the invention.
Figure 3B:
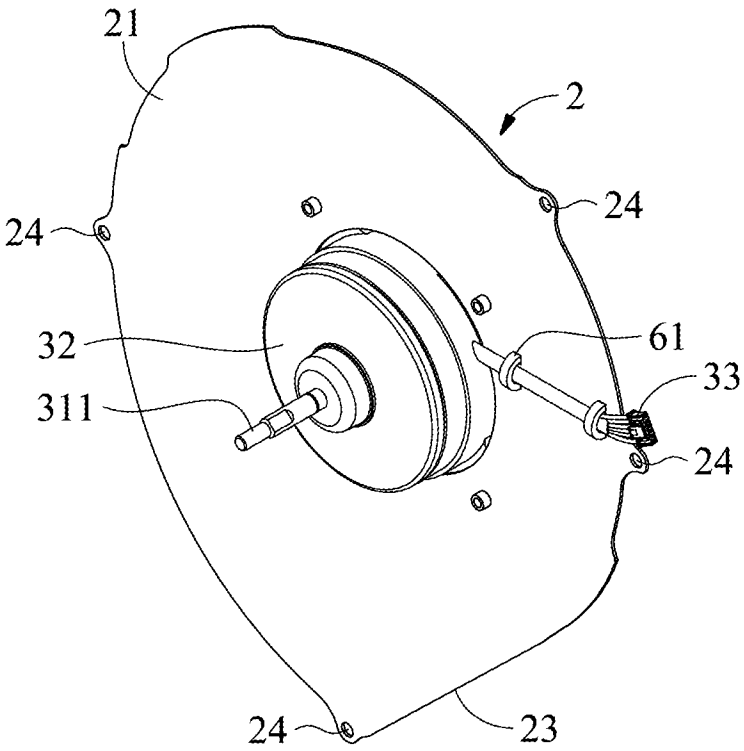
FIG. 3B is an assembled view of the details of the spacer and the co-axial motor of the embodiment of the invention.

FIG. 3A is an exploded view of the details of the spacer and the co-axial motor of the embodiment of the invention. FIG. 3B is an assembled view of the details of the spacer and the co-axial motor of the embodiment of the invention. With reference to FIGS. 2, 3A and 3B, in one embodiment, the air mover D further comprises a mounting base 51. The spacer 2 comprises a first surface 21 and a second surface 22. The co-axial motor 3 comprises a motor body 32. The mounting base 51 is disposed on the second surface 22. The motor body 32 passes through the spacer 2. The mounting base 51 affixes the motor body 32 to the spacer 2.

Figure 4:
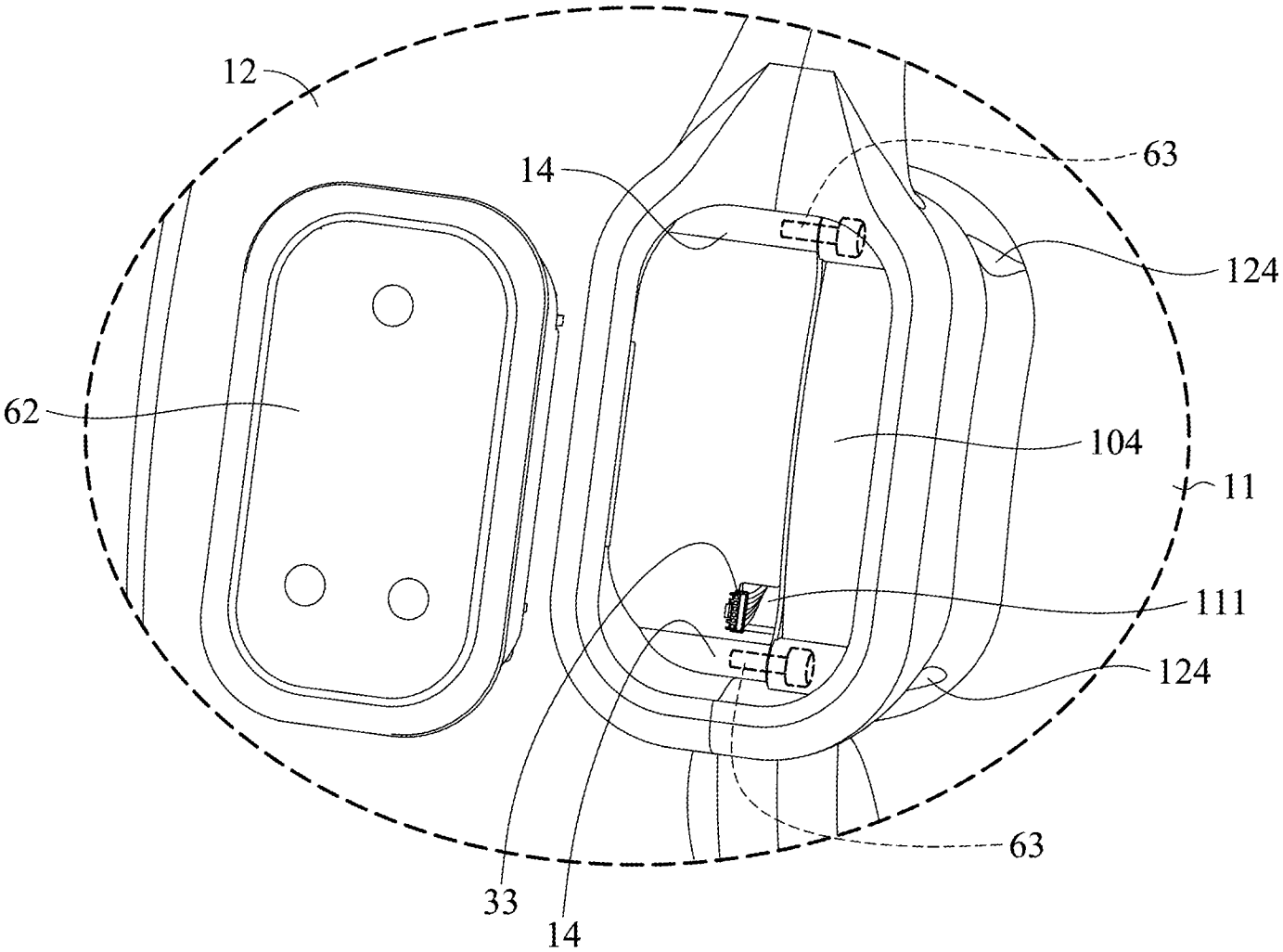
FIG. 4 shows the details of the recess of the embodiment of the invention.

With reference to FIGS. 3B and 4, in one embodiment, the co-axial motor 3 comprises a cable 33. The cable 33 is connected to the motor body 32. The cable 33 travels from the motor body 32, extends over the first surface 21, passes through a cable notch 111 of the first housing member 11, and leaves the first chamber C1.

With reference to FIG. 3B, in one embodiment, the air mover further comprises at least one positioner 61, wherein the positioner 61 is disposed on the first surface 21 and restricts the cable 33.

In the embodiment of the invention, the cable 33 extends over the first surface 21, and is restricted by the positioner 61. Therefore, the cable 33 is prevented from being interference with the neighboring elements during the assembling process of the air mover.

With reference to FIG. 4, in one embodiment, the air mover D further comprises a controller 62. The housing 1 comprises a recess 104. The controller 62 is embedded in the recess 104. The cable notch 111 is located on the bottom of the recess 104, and the cable 33 is coupled to the controller 62.

With reference to FIG. 1A, in one embodiment, the air mover D further comprises a plurality of first bolts 63. The first housing member 1 comprises a plurality of fastening bases 14. The second housing member 12 has a plurality of through holes 124. The spacer 2 has a plurality of through holes 24. Each first bolt 63 passes through the corresponding through hole 124 and through holes 24, and is affixed to the corresponding fastening base 14. The first bolts 63 sequentially connect the second housing member 12, the spacer 2 and the first housing member 11.

With reference to FIG. 4, in one embodiment, the recess 104 is formed above the seam line between the first housing member 11 and the second housing member 12. One of the first bolts 63 is affixed to one of the fastening base 14 at the recess 104.

Figure 5:
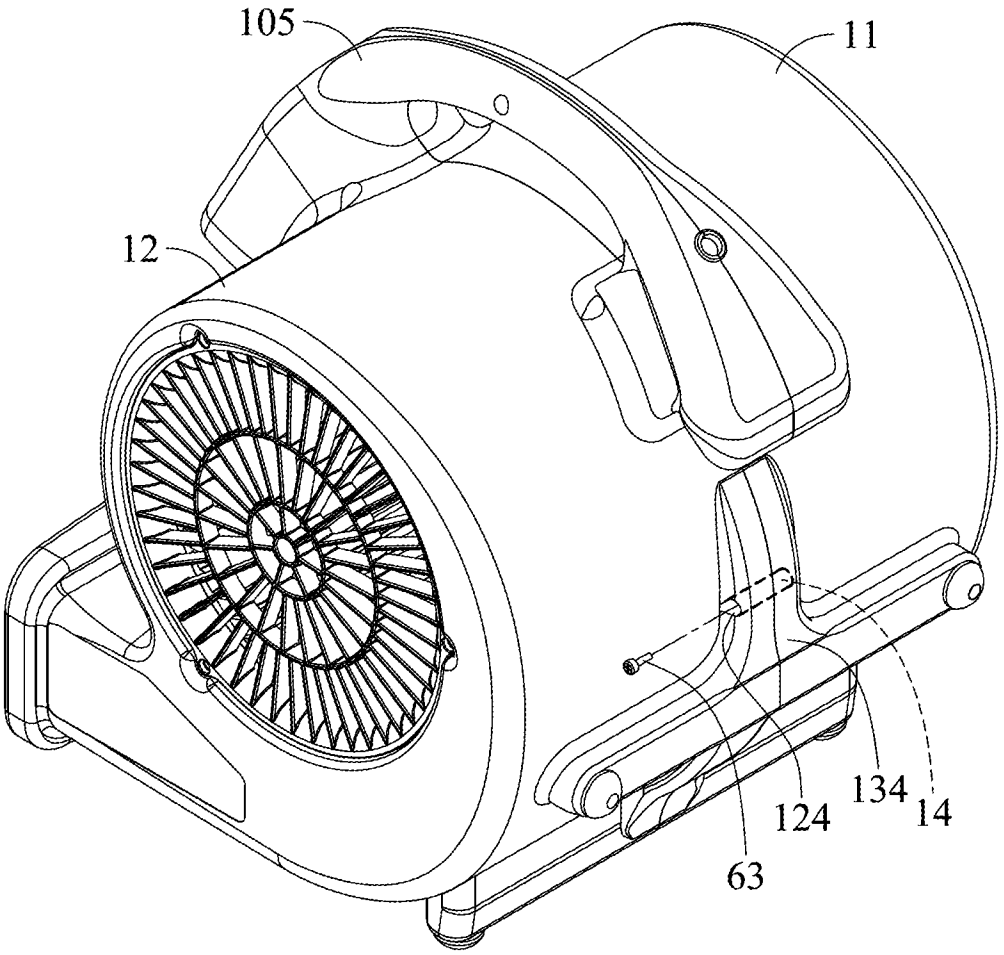
FIG. 5 shows the first rib of the embodiment of the invention.

With reference to FIG. 5, in one embodiment, the housing 1 comprises a first rib 134. The first rib 134 is formed on the seam line between the first housing member 11 and the second housing member 12, and the first rib 134 corresponds to the recess 104. One of the first bolts 63 is affixed to one of the fastening base 14 at the first rib 134.

Figure 6:
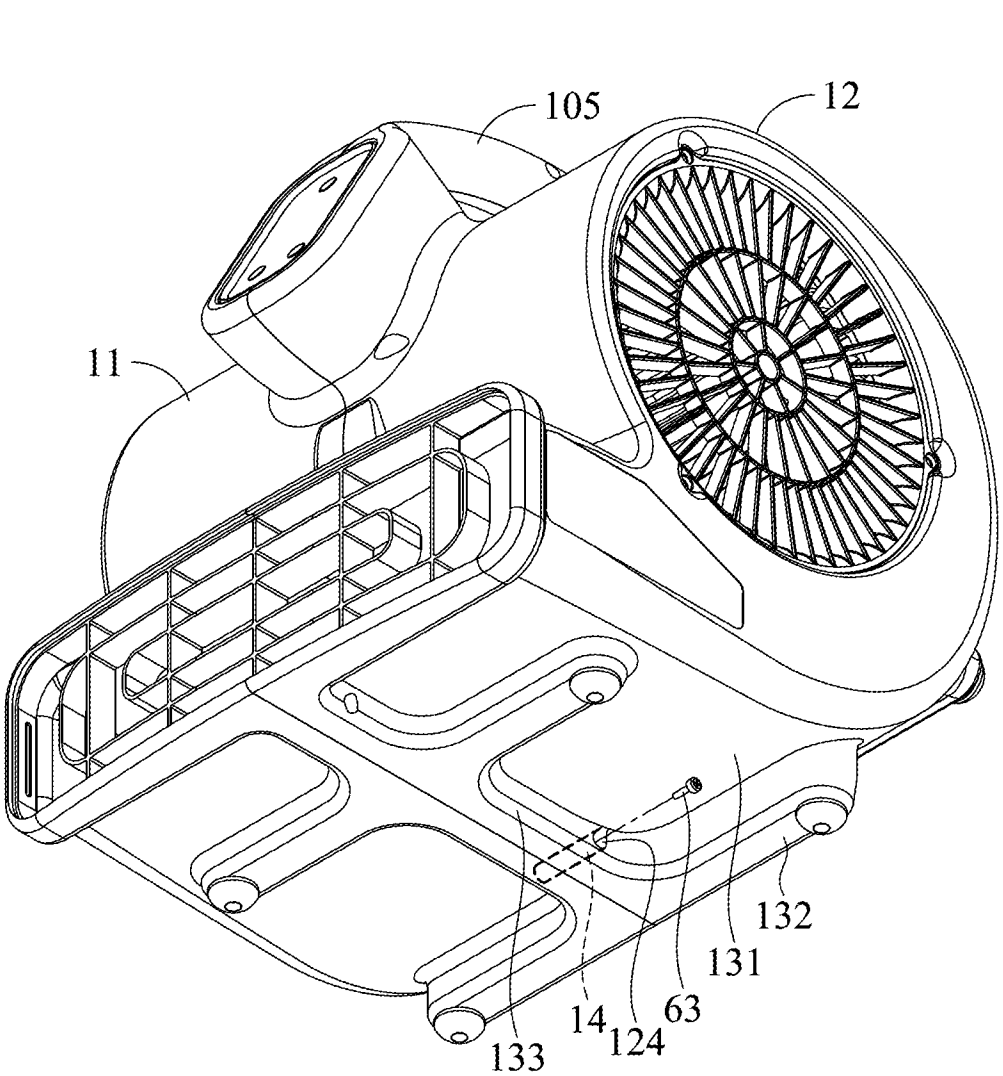
FIG. 6 shows the second rib of the embodiment of the invention.

With reference to FIGS. 1A, 1B and 6, in one embodiment, the housing 1 comprises a bottom surface 131, a plurality of supporting portions 132 and a second rib 133. The supporting portions 132 and the second rib 133 are formed on the bottom surface 131. The second rib 133 is formed on the seam line between the first housing member 11 and the second housing member 12. One of the first bolts 63 is affixed to one of the fastening base 14 at the second rib 133.

With reference to FIGS. 1A and 1B, in one embodiment, the spacer 2 separates the first chamber C1 and the second chamber C2. The first flow A1 enters the first chamber C1 through the first inlet 101 and is impelled by the first fan 41 to leave the first chamber C1 via the outlet 103. The second flow A2 enters the second chamber C2 through the second inlet 102 and is impelled by the second fan 42 to leave the second chamber C2 via the outlet 103. The first flow A1 and the second flow A2 are combined into a third flow A3 in the outlet 103.

In the embodiment above, the first bolts 63 fastens the second housing member 12, the spacer 2 and the first housing member 11 simultaneously. The spacer 2, the first fan 41, the second fan 42 and the co-axial motor 3 can be firmly affixed. Additionally, the spacer 2 sufficiently separates the first chamber C1 from the second chamber C2, the flow field inside the first chamber C1 is separated from the flow field inside the second chamber C2, and the operation efficiency of the air mover is improved.

Figure 7:
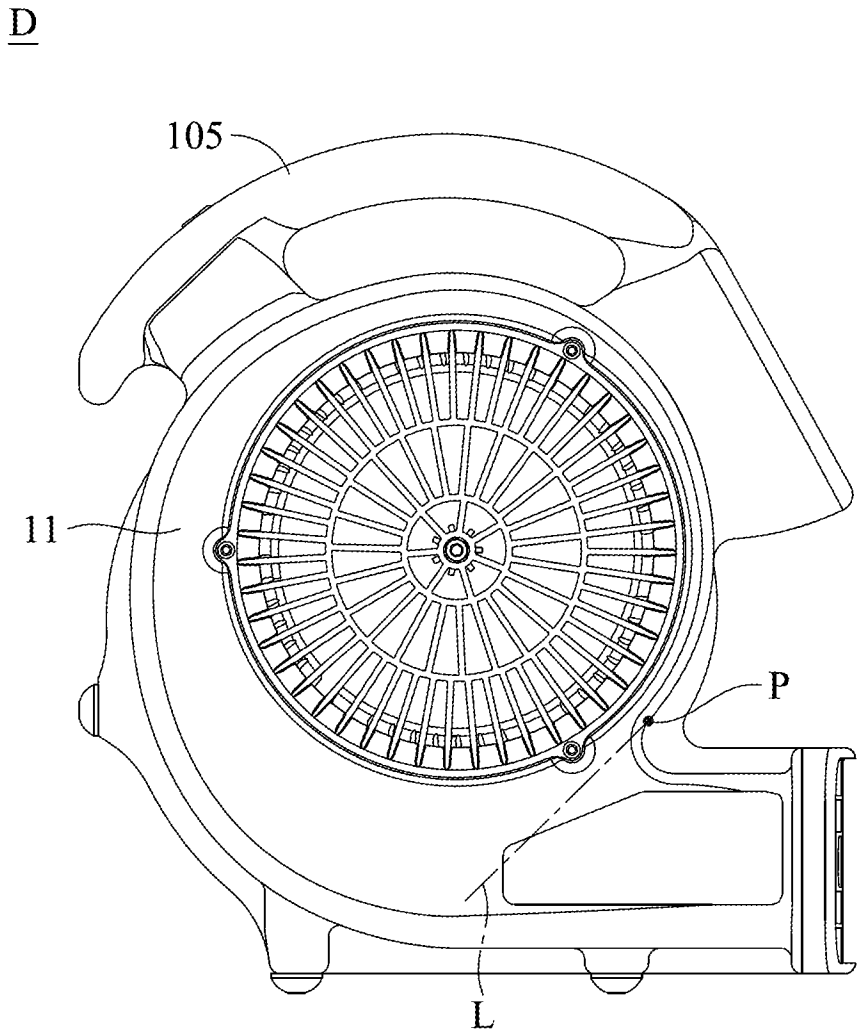
FIG. 7 shows the tangent line overlaps the edge of the spacer of the embodiment of the invention.

With reference to FIGS. 1A and 7, in one embodiment, on a projection plane, a reverse point P is formed between a chamber profile of the first chamber C1 and an outlet profile of the outlet 103. A tangent line L of the chamber profile on the reverse point P overlaps an edge 23 of the spacer 2. In one embodiment, the tangent line L that overlaps the edge 23 impedes the generation of a vortex.

Figure 8:
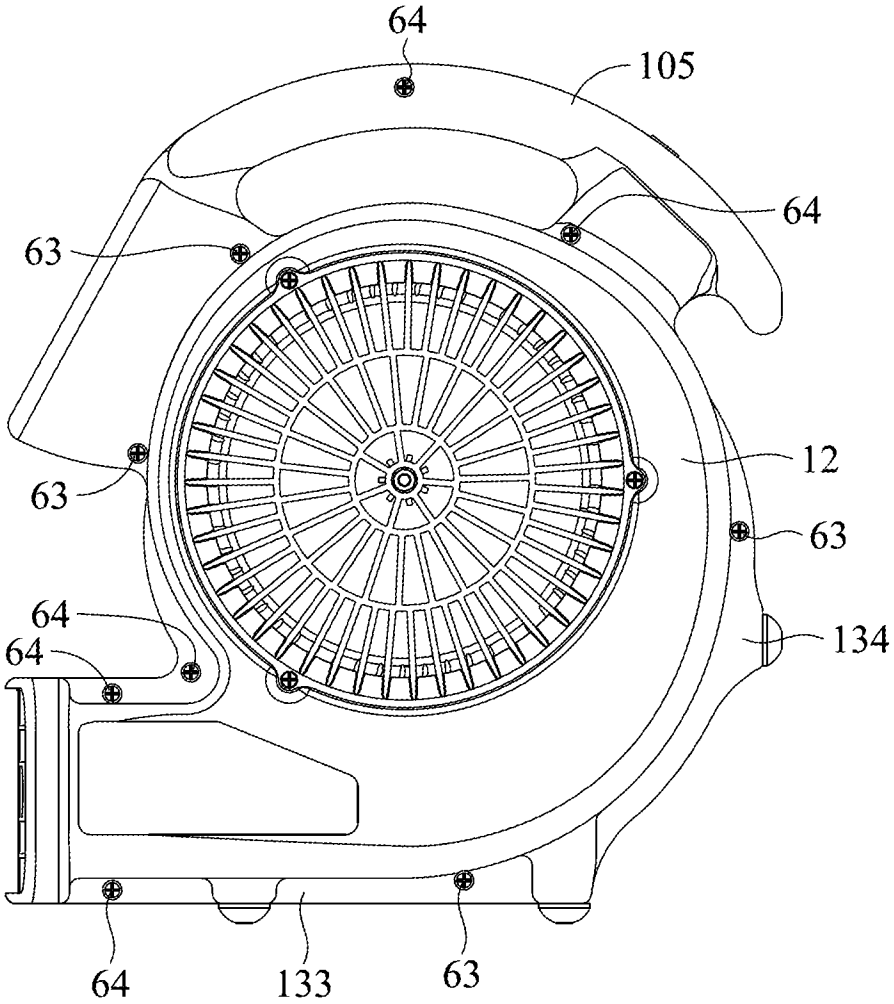
FIG. 8 shows the second bolts of the embodiment of the invention.

With reference to FIG. 8, in one embodiment, the air mover D further comprises a plurality of second bolts 64. The second bolts 64 connect the first housing member 11 and the second housing member 12. The second bolts 64 are disposed on a handle 105, the second rib 133 and the neighboring structure of the outlet 103.

With reference to FIG. 1A, in one embodiment, a first filter 71 is disposed in the first inlet 101, a second filter 72 is disposed in the second inlet 102, and a third filter 73 is disposed in the outlet 103. The first filter 71 and the second filter 72 prevent foreign objects from entering the first inlet 101 and the second inlet 102. The third filter 73 prevents foreign objects from entering the outlet 103.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term).

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An air mover, comprising:

a housing, comprising a first housing member and a second housing member, wherein a first inlet, a second inlet and an outlet are formed on the housing, the first inlet is formed on the first housing member and the second inlet is formed on the second housing member;

a spacer, disposed between the first housing member and the second housing member;

a co-axial motor, comprising a shaft, wherein the co-axial motor is disposed on the spacer, the shaft comprises a first free end and a second free end, the first free end extends in a first direction, and the second free end extends in a second direction;

a first fan, connected to the first free end, wherein the first fan is located in a first chamber formed by the first housing member and the spacer, and the first fan corresponds to the first inlet;

a second fan, connected to the second free end, wherein the second fan is located in a second chamber formed by the second housing member and the spacer, and the second fan corresponds to the second inlet, wherein a first distance between the first free end and the spacer is equal to a second distance between the second free end and the spacer;

a mounting base, wherein the spacer comprises a first surface and a second surface, the co-axial motor comprises a motor body, the mounting base is disposed on the second surface, the motor body passes through the spacer, and the mounting base affixes the motor body to the spacer, wherein the co-axial motor comprises a cable, the cable is connected to the motor body, and the cable travels from the motor body, extends over the first surface, passes through a cable notch of the first housing member, and leaves the first chamber; and wherein the air mover further comprises at least one positioner, wherein the positioner is disposed on the first surface and restricts the cable.

2. The air mover as claimed in claim 1, further comprising a plurality of first bolts, the first housing member comprises a plurality of fastening bases, the second housing member and the spacer have a plurality of through holes, each first bolt passes through a corresponding through hole and is affixed to a corresponding fastening base, and the first bolts connect the second housing member, the spacer and the first housing member.

3. The air mover as claimed in claim 1, wherein the housing comprises a bottom surface, a plurality of supporting portions and a second rib, the supporting portions and the second rib are formed on the bottom surface, and the second rib is formed on a seam line between the first housing member and the second housing member.

4. The air mover as claimed in claim 1, wherein the spacer separates the first chamber and the second chamber, a first flow enters the first chamber through the first inlet and is impelled by the first fan to leave the first chamber via the outlet, and a second flow enters the second chamber through the second inlet and is impelled by the second fan to leave the second chamber via the outlet.

5. The air mover as claimed in claim 1, wherein on a projection plane, a reverse point is formed between a chamber profile of the first chamber and an outlet profile of the outlet, a tangent line of the chamber profile on the reverse point overlaps an edge of the spacer.

6. The air mover as claimed in claim 1, wherein a radius of the first fan is equal to a radius of the second fan.

7. The air mover as claimed in claim 1, wherein a size of the first inlet is equal to a size of the second inlet.

8. An air mover, comprising:

a housing, comprising a first housing member and a second housing member, wherein a first inlet, a second inlet and an outlet are formed on the housing, the first inlet is formed on the first housing member and the second inlet is formed on the second housing member;

a spacer, disposed between the first housing member and the second housing member;

a co-axial motor, comprising a shaft, wherein the co-axial motor is disposed on the spacer, the shaft comprises a first free end and a second free end, the first free end extends in a first direction, and the second free end extends in a second direction;

a first fan, connected to the first free end, wherein the first fan is located in a first chamber formed by the first housing member and the spacer, and the first fan corresponds to the first inlet;

a second fan, connected to the second free end, wherein the second fan is located in a second chamber formed by the second housing member and the spacer, and the second fan corresponds to the second inlet, wherein a first distance between the first free end and the spacer is equal to a second distance between the second free end and the spacer a mounting base, wherein the spacer comprises a first surface and a second surface, the co-axial motor comprises a motor body, the mounting base is disposed on the second surface, the motor body passes through the spacer, and the mounting base affixes the motor body to the spacer, wherein the co-axial motor comprises a cable, the cable is connected to the motor body, and the cable travels from the motor body, extends over the first surface, passes through a cable notch of the first housing member, and leaves the first chamber; and wherein the air mover further comprises a controller, wherein the housing comprises a recess, the recess is formed above a seam line between the first housing member and the second housing member, the controller is embedded in the recess, the cable notch is located on a bottom of the recess, and the cable is coupled to the controller.

9. The air mover as claimed in claim 8, wherein the housing comprises a first rib, the first rib is formed on a seam line between the first housing member and the second housing member, and the first rib corresponds to the recess.

* * * * *